US006981574B1

(12) United States Patent
Bedi

(10) Patent No.: US 6,981,574 B1
(45) Date of Patent: Jan. 3, 2006

(54) DIPSTICK OIL CHANGE SYSTEM

(75) Inventor: Ram D. Bedi, Bloomfield Hills, MI (US)

(73) Assignee: K.J. Manufacturing Co., Wixom, MI (US)

( * ) Notice: Subject to any disclaimer, the term of this patent is extended or adjusted under 35 U.S.C. 154(b) by 253 days.

(21) Appl. No.: 10/318,864

(22) Filed: Dec. 13, 2002

(51) Int. Cl.
*F16C 3/14* (2006.01)

(52) U.S. Cl. ..... 184/1.5; 123/196 R

(58) Field of Classification Search ..... 184/1.5, 184/6.5, 105.1; 123/196 R, 196 S
See application file for complete search history.

(56) References Cited

U.S. PATENT DOCUMENTS 4,378,026 A * 3/1983 Bauer ..... 137/205
5,074,380 A * 12/1991 Bedi et al. ..... 184/1.5
5,881,840 A * 3/1999 Mize ..... 184/1.5
6,138,722 A * 10/2000 Willingham ..... 141/98
6,213,173 B1 4/2001 Bedi et al. ..... 141/65
6,321,874 B1 * 11/2001 Miyamoto ..... 184/1.5

OTHER PUBLICATIONS

Hard copy of internet website http://www.esocinc.com/esoc.htm; dated May 16, 2001; two (2) pages; Author Unknown.

* cited by examiner

*Primary Examiner*—David M. Fenstermacher
(74) *Attorney, Agent, or Firm*—Young & Basile, P.C.

(57) ABSTRACT

A dipstick oil change system is provided wherein oil to be removed from the engine is drawn through the conduit that encloses or sheathes the dipstick, The conduit includes a first opening positionable in the oil pan of the engine, a second opening that can be selectively sealed, and a third opening for receiving the dipstick. Oil removal means such as vacuum means can be engaged with the second opening and define a vacuum to draw oil out of the oil pan. The connection between the second opening and the vacuum means can include quick connect fittings.

16 Claims, 1 Drawing Sheet

DIPSTICK OIL CHANGE SYSTEM

FIELD OF THE INVENTION

The invention relates to an apparatus and method for removing oil with respect to an engine, and more specifically, the invention provides a method and apparatus for changing the oil disposed in an engine through the conduit sheathing the dipstick.

BACKGROUND OF THE INVENTION

The benefits of routine oil changes in an internal combustion engine are well known. Routine oil changes have been shown to increase engine life and performance. With repeated prolonged use, motor oil builds up suspended particles, metallic and non-metallic, from the abrasive wear of engine parts against one another and from products of incomplete combustion and improper air intake. The particles in turn cause abrasive wear of the engine bearings, piston rings and other moving parts and the reduction of the motor oil lubricity as various additives and lubricating components become depleted. This adversely affects engine performance and if left unchanged can destroy or cripple the engine performance. It is recommended by at least one oil manufacturer that the level of total solid concentration be limited to levels below 0.03%.

To obtain satisfactory engine performance, and maintain solids concentration levels in the motor oil lower than the recommended 0.03%, changing the motor oil in an internal combustion engine is necessary. In currently designed vehicles, the oil pan serves the purpose of a reservoir for circulation of engine oil. Engine lubrication is generally accomplished through a gear-type pump. Oil from the pump passes through the oil filter before going to the engine oil galleries where it provides lubrication to the various engine components.

To remove the contaminated oil, the drain plug, generally located in the lowermost region of the oil pan, is opened. The spent oil containing suspended particles is permitted to flow under gravity out of the pan into a suitable receptacle. After the spent oil is removed, the plug is replaced and fresh oil is added to the engine through a separate opening in the engine valve cover. The process of gravity drainage does not remove all of the spent oil with its metallic and non-metallic particles which stick to the oil pan container walls, as well as engine components such as the crank shaft, connecting rods, pistons and the like which are exposed to the motor oil spray lubrication. These particles can remain to be mixed with fresh motor oil Thus the concentration of contaminants is lowered by dilution but only a part of the total contaminates are actually eliminated.

SUMMARY OF THE INVENTION

The present invention provides au apparatus and method for removing oil from an engine has an oil pan and an oil inlet. The system according to the present invention includes a conduit positionable with respect to the engine. The conduit can be fixedly or immovably connected to the engine. The conduit includes a first opening positioned in the oil pan of the engine and a second opening positioned outside of the oil pan of the engine. A seal that can be opened and closed is positioned over the second opening. The seal can include a quick connect fit oil can be removed from the oil pan through the conduit.

The conduit can also include a third opening. The dipstick of the vehicle can be inserted in the third opening and extend to the first opening in the oil pan. The invention can also include a seal, such as a gasket or o-ring for sealing the dipstick and the third opening.

The invention can also include a vacuum or pump to draw oil out of the oil pan through the conduit. The vacuum or pump can include a quick connect fitting to engage the quick connect fitting positioned over the second opening. When the vacuum is engaged with the second opening, a vacuum can be applied to draw oil out of the oil pan and into a container.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
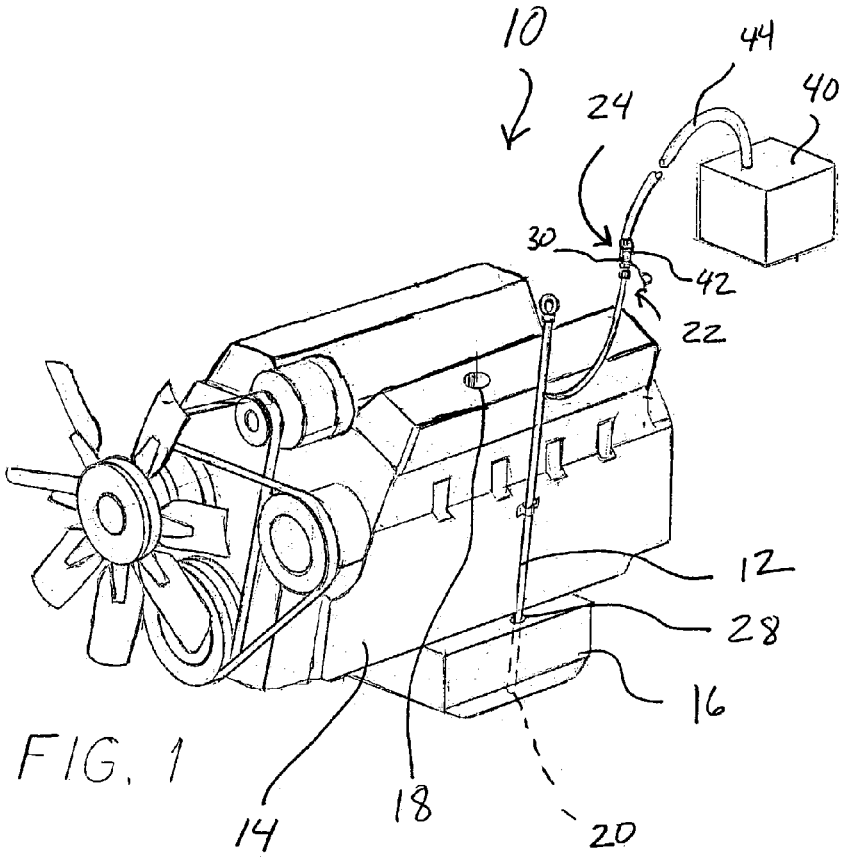
FIG. 1 is an isometric view of the dipstick oil change system associated with an engine.
Figure 2:
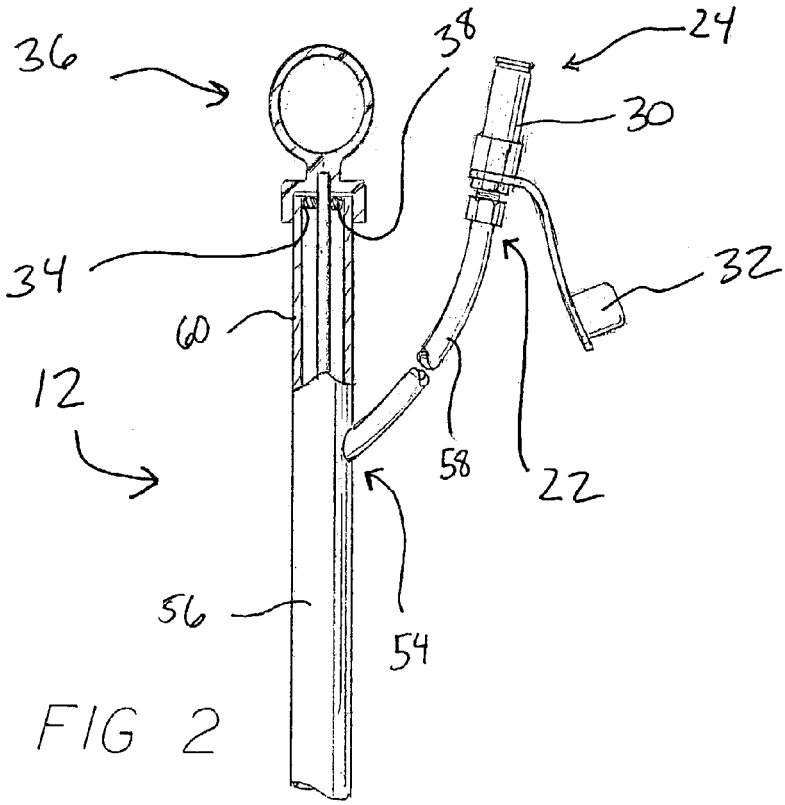
FIG. 2 is a partial cross-sectional view of an conduit according to the invention.

The invention provides a method and apparatus, or an oil change system 10 for moving oil with respect to an engine 14 having an oil pan 16 and an oil inlet 18. The system 10 includes a conduit 12 positionable with respect to the engine 14. The conduit 12 includes a first opening 20 positionable internal with respect to the oil pan 16 of the engine 14. The conduit 12 also includes a second opening positionable external with respect to the oil pan 16 of the engine 14. The system 10 also includes sealing means 24 engagable with respect to the second opening 22 to selectively seal the second opening 22. During an oil change, oil disposed in the oil pan can be drawn out of the oil pan through the conduit 12.

The conduit 12 can be positioned with respect to the engine 14 with means 26 for fixedly associating, or immovably associating, the conduit 12 with respect to the engine 14. In particular, means 26 can include fasteners, a clasp, a bracket and the like for maintaining the position of the conduit 12 relative to the engine 14 while the associated vehicle is moving and while the associated vehicle is not moving. The conduit 12 can be inserted with respect to an aperture 28 defined by the oil pan 16. The first opening 20 of the conduit 12 can be disposed approximate the lowest or deepest portion of the oil pan 16 to increase the likelihood that all of the oil disposed in the oil pan 16 can be drawn out of the oil pan 16 through the conduit 12. The second opening 22 of the conduit 12 is positionable external with respect to the oil pan and the engine so that oil disposed in the oil pan 16 can be drawn out of the oil pan 16 during an oil change. Sealing means 24 is engagable with respect to the second opening 22 to selectively seal the second opening 22. For example, the second opening can be sealed when oil disposed in the oil pan 16 is not being removed from the oil pan and can be unsealed or open when oil is being removed. Sealing means 24 can include a quick connect fitting 30. The invention can also include a cap 32 positionable over the quick connect fitting 30 to protect the fitting 30 between oil changes.

The conduit 12 can also include or define a third opening 34. A dipstick 36 can be formed to be insertable with respect to the third opening 34. The second and third openings can be adjacent with respect to one another approximate a top or upper portion of the engine. It can be desirable to position the second opening such that the second opening is readily accessible when the vehicle's hood is raised or the cab is rotated to expose the engine.

The conduit 12 can define a T-shape or Y-shape with a junction portion 54. The conduit 12 can include a first portion 56 extending from the junction portion 54 to the first opening 20. A second portion 58 of the conduit 12 can extend from the junction portion 54 to the second opening 22. The conduit 12 can also include a third portion 60 extending from the junction portion 54 to the third opening 34. The portions 56, 58 and 60 can be substantially similar in diameter. Alternatively, the diameters of the portions 56 and 60 can be substantially similar and the diameter of the portion 58 can be less than the diameters of the portions 56 and 60.

The invention can also include second sealing means 38 to seal the dipstick 36 with respect to the third opening 34. Sealing means 38 can include a gasket or an o-ring. In operation, vacuum means 40 can engage the second opening 22 in fluid communication and define a vacuum with respect to the second opening 22 to move oil disposed in the oil pan 16 with respect to the engine 14 through the conduit 12. Sealing means 38 reduces the likelihood that air will enter the third opening and detract or compromise the effectiveness of the vacuum defined by vacuum means 40 for drawing oil through the conduit 12. Vacuum means 40 can include a quick connect fitting 42 engagable with the quick connect fitting 30 to place the vacuum means 40 in fluid communication with the second opening 22, the conduit 12, and the oil pan 16. Vacuum means 40 can include a pump for defining a vacuum to draw oil disposed in the oil pan 16 out of the oil pan 16, through the conduit 12 and into vacuum means 40. Vacuum means 40 can include a flexible or inflexible conduit 44 operably associated with the quick connect fitting 42. In operation, the cap 32 can be removed with respect to the quick connect fitting 30. The quick connect fitting 42 can be engaged with the quick connect fitting 30. Vacuum means 40 can be engaged to define a vacuum and draw oil disposed in the oil pan 16 through the conduit 12 and into the vacuum means 40.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for removing oil with respect to an engine having an oil pan, the apparatus comprising:

a conduit positioned with respect to the engine, the conduit having a first opening positioned internal with respect to the oil pan of the engine, a second opening positionable external with respect to the oil pan of the engine, and a third opening distinct from the first and second openings;

sealing means engagable with respect to the second opening to selectively seal the second opening;

means for fixedly associating the conduit with respect to the engine; and a dip stick removably inserted in sealed engagement with the third opening, the dip stick having an elongate end removably contained within the conduit.

2. The apparatus according to claim 1, further comprising:

means for sealing the dip stick with respect to the third opening.

3. The apparatus of claim 1 further comprising;

vacuum means for engaging the second opening in fluid communication and defining a vacuum with respect to the second opening to move oil with respect to the engine through the conduit.

4. The apparatus of claim 1 wherein the associating means are configured to position the conduit during engine operation.

5. The apparatus of claim 4 wherein sealing means further comprises:

a quick connect fitting.

6. The apparatus of claim 1 wherein the first opening of the conduit is disposed approximate the lowest or deepest portion of the oil pan for drawing out the oil in the oil pan.

7. An apparatus for removing oil with respect to an engine having an outer surface and an oil pan, the apparatus comprising:

a conduit positioned with respect to the engine, the conduit having a first opening positioned internal with respect to the oil pan of the engine and a second opening positioned external with respect to the oil pan of the engine;

sealing means engagable with respect to the second opening to selectively seal the second opening, the sealing means including a quick connect fitting;

at least one attachment device connected to the conduit and the outer surface of the engine, the attachment fixedly connecting the conduit with the engine during engine operation.

8. A method of removing oil with respect to an engine having an oil pan comprising the steps of:

positioning a conduit with respect to an engine, the conduit having a first opening positioned internal with respect to the oil pan of the engine, a second opening positioned external with respect to the oil pan of the engine, and a third opening distinct from the first and second openings the conduit further including a dip stick removably inserted in sealed engagement with the third opening the din stick having an elongate end removably contained within the conduit;

selectively sealing the second opening with sealing means engagable with respect to the second opening;

fixing the conduit with respect to the engine such that the conduit remains in place during engine options; and removing at least a portion of oil in the oil pan through the conduit.

9. The method of claim 8 further comprising the step of:

immovably associating the conduit with respect to the engine.

10. The method of claim 8 wherein the oil removal step comprises the steps of:

engaging vacuum means in fluid communication with respect to sealing means; and defining a vacuum with respect to the second opening with vacuum means to move oil with respect to the engine through the conduit.

11. The method of claim 8 wherein the selectively sag step further comprising the step of:

engaging a quick connect fitting with the second opening.

12. The method of claim 8 further comprising the step of:

defining a third opening with respect to the conduit.

13. The method of claim 8 further comprising the step of:

sealing the dip stick with respect to the third opening with second sealing means.

14. The method of claim 13 wherein the selectively sealing step further comprising the step of:

engaging a quick connect fitting with the second opening.

15. A method of removing oil with respect to an engine having an oil pan and an oil inlet comprising the steps of:

positioning a conduit with respect to an engine, the conduit having a first opening internal with respect to the oil pan of the engine and a second opening positioned external with respect to the oil pan of the engine and a third opening operable to removably receive a dip stick;

selectively sealing the second opening with a quick connect fitting engagable with respect to the second opening;

engaging vacuum means with respect to quick connect fitting in fluid communication with respect to the quick connect fitting; and defining a vacuum with respect to the second opening with vacuum means to move oil with respect to the engine through the conduit.

16. The method of claim 15 further comprising the step of:

sealing the dip stick with respect to the third opening with second sealing means.

* * * * *